US005291252A

United States Patent [19]

Kawaishi

[11] Patent Number: 5,291,252

[45] Date of Patent: Mar. 1, 1994

[54] MULTICOLOR IMAGE FORMING APPARATUS WITH TENSION CONTROLLED IMAGE TRANSFER BELT

[75] Inventor: Yasunori Kawaishi, Narashino, Japan

[73] Assignee: Ricoh Company, Ltd., Tokyo, Japan

[21] Appl. No.: 932,575

[22] Filed: Aug. 20, 1992

[30] Foreign Application Priority Data

Aug. 26, 1991 [JP] Japan ..... 3-213934

[51] Int. Cl.[5] ..... G03G 15/14

[52] U.S. Cl. ..... 355/272; 355/271

[58] Field of Search ..... 355/200, 271, 272, 273, 355/326, 327, 212

[56] References Cited

U.S. PATENT DOCUMENTS 3,838,919 10/1974 Takahashi ..... 355/327
4,183,658 1/1980 Winthaegen ..... 355/212
4,515,460 5/1985 Knechtel ..... 355/327
4,869,707 9/1989 in't Zandt et al. ..... 355/212 X
4,984,026 1/1991 Nishise et al. ..... 355/271 X

*Primary Examiner*—A. T. Grimley
*Assistant Examiner*—Sandra L. Brasé
*Attorney, Agent, or Firm*—Oblon, Spivak, McClelland, Maier & Neustadt

[57] ABSTRACT

A multicolor image forming apparatus having an image transfer structure capable of preventing a transferred image and an image formed on a photoconductive element from being dislocated from each other. A backup roller facing a photoconductive element and a tension roller are movable toward and away from the element at the same time over the same distance. A single cam intervenes between support members supporting the two rollers and moves the rollers by half a rotation thereof.

13 Claims, 4 Drawing Sheets

MULTICOLOR IMAGE FORMING APPARATUS WITH TENSION CONTROLLED IMAGE TRANSFER BELT

BACKGROUND OF THE INVENTION

The present invention relates to a multicolor image forming apparatus and, more particularly, to an image transfer structure for transferring an image from a photoconductive element to an intermediate image transfer body.

In a multicolor image forming apparatus capable of forming an image in full color or two or more colors, images sequentially developed in different colors on a photoconductive element are transferred to an intermediate image transfer body one above another and then transferred to a paper sheet or similar recording medium at the same time. The intermediate image transfer body is often implemented as a belt passed over a plurality of pulleys and long enough to accommodate an image of maximum size available with the apparatus. The prerequisite with this kind of image forming apparatus is that the images of different colors be transferred to the belt in accurate register with one another. To meet this requirement, there has been proposed a structure which, on completing the transfer of an image of particular color, moves the belt in the same direction but at a speed higher than the speed necessary for image transfer and again moves the belt at the speed necessary for image transfer as it approaches an image transfer position, thereby causing the leading end of the image present on the belt to meet that of the image present on the photoconductive element. There has also been proposed a structure which, on completing the transfer of an image of a particular color, moves the belt in the opposite direction for thereby bringing the image on the belt into register with the image on the photoconductive element. In any of these structures, the belt is movable toward and away from the photoconductive element. Specifically, among a plurality of rollers over which the belt is passed, a roller facing the photoconductive element may be moved toward and away from the element, as disclosed in Japanese Patent Laid-Open Publication No. 164372/1981. Alternatively, a support member supporting all of the plurality of rollers may be implemented as a pivotable member whose side facing the photoconductive element is movable toward and away from the element, as taught in Japanese Utility Model Laid-Open Publication No. 109963/1988.

The conventional structures, however, have various problems left unsolved, as follows. When only one of the rollers is moved toward and away from the photoconductive element, the tension of the belt decreases on the movement of the belt away from the photoconductive element. This causes the belt and the roller to slip on each other when, for example, the belt is driven when spaced apart from the photoconductive element, dislocating the image transferred to the belt from the next image formed on the element. When the support member is bodily moved in a pivotal motion, a change in the load during the movement is apt to prevent the image transferred to the belt from being brought into register with the image on the photoconductive element.

SUMMARY OF THE INVENTION

It is, therefore, an object of the present invention to provide a multicolor image forming apparatus having an image transfer structure capable of preventing a transferred image from being brought out of register with an image formed on a photoconductive element.

In accordance with the present invention, in an image transfer structure for a multicolor image forming apparatus for sequentially transferring developed images of different colors formed one after another on a photoconductive element to an intermediate image transfer belt one above another and then transferring the developed images from the intermediate image transfer belt to a recording medium at the same time to thereby form a full-color image, wherein the images are brought into register by either of a skip forward system which during a non-transfer period shifts the intermediate transfer belt away from the photoconductive element and moves it at a speed different from a previous speed and a quick return system which during a non-transfer period shifts the intermediate transfer belt away from the photoconductive element and moves it in a direction opposite to a previous direction, a belt support device is provided which comprises a backup roller supporting the intermediate image transfer belt at a position where the backup roller faces the photoconductive element, and a tension roller applying tension to the intermediate image transfer belt. A roller drive device shifts the backup roller and tension roller to move the belt toward and away from the photoconductive element such that the belt has the same tension when shifted into contact with the photoconductive element and when shifted out of contact with the element.

Also, in accordance with the present invention, in an image transfer structure for a multicolor image forming apparatus of the type described, a belt constituting an intermediate image transfer body is passed over a plurality of rollers including a backup roller facing the photoconductive element and a tension roller. A support device causes the backup roller and tension roller to angularly move substantially at the same time such that the belt selectively moves toward or away from the photoconductive element.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
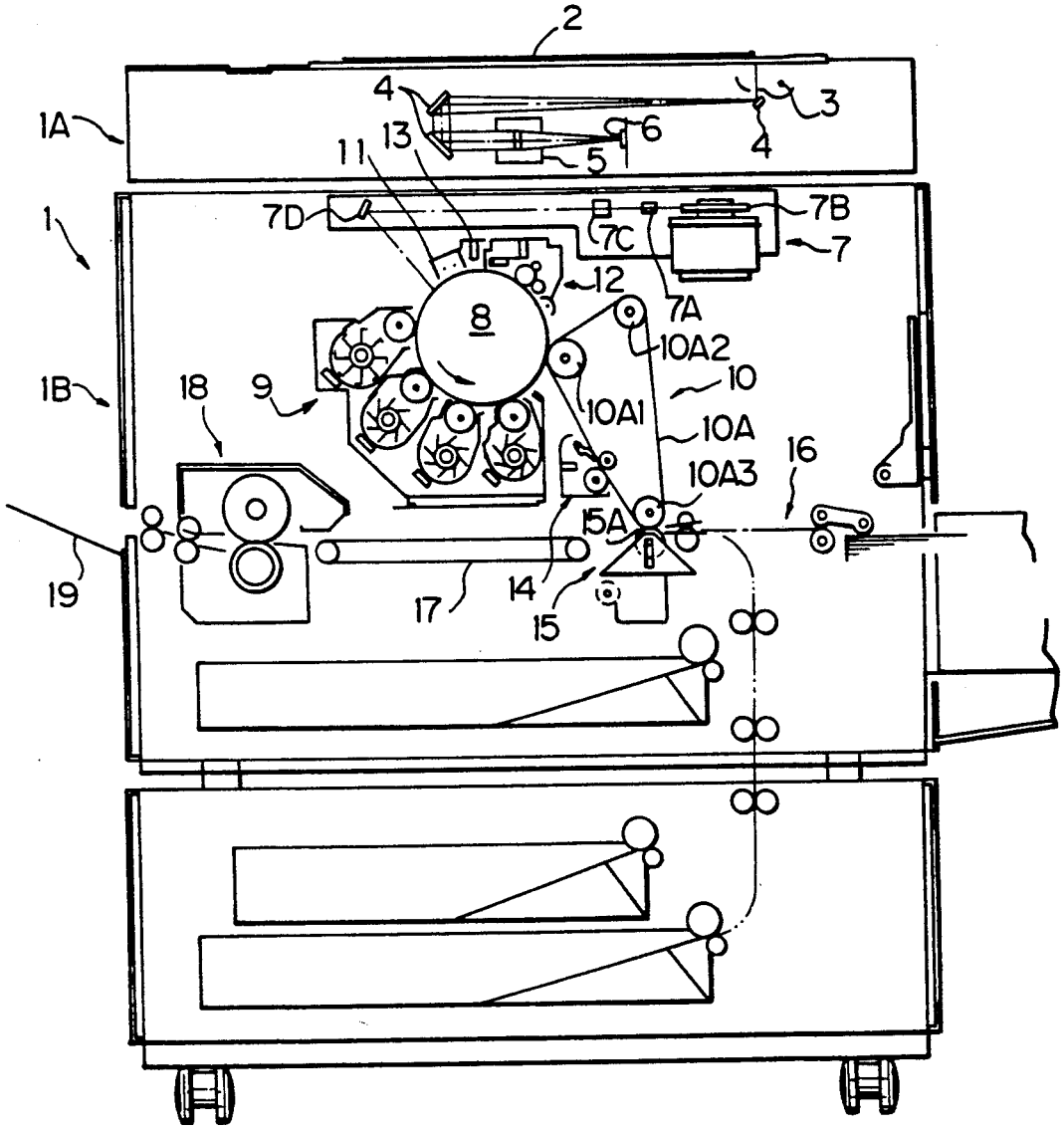
FIG. 1 is a section showing a multicolor image forming apparatus embodying the present invention.

Referring to FIG. 1 of the drawings, a multicolor image forming apparatus embodying the present invention is shown and generally designated by the reference numeral 1. As shown, the image forming apparatus 1 is generally made up of a document reading section 1A and an image recording section 1B. The document reading section 1A constitutes a scanner for reading a color document laid on a glass platen with a photoelectric transducer. Specifically, the document reading section 1A is disposed above the image recording section 1B and has a glass platen 2, a light source 3, a mirror 4, a lens 5, and a color sensor 6. The color sensor 6 is implemented by a CCD (Charge Coupled Device) image sensor or similar photoelectric transducer for receiving a color-separated reflection from a document. More specifically, an imagewise reflection from a document is sequentially separated into, for example, a blue component, green component and red component in this order. The color sensor 6 reads such color components as color image data and delivers image signals corresponding to the image data to an image processing unit, not shown. The image processing unit executes color conversion on the basis of the output signals of the color sensor 6 which are associated with the intensity levels of the image. The color conversion includes the conversion of the above-mentioned colors to complementary colors, i.e., cyan, magenta and yellow, the enhancement of tonality, and, in the case of a black-and-white image, the conversion of black. The output of the image processing unit is fed to the image recording section 1B.

The image recording section 1B has a writing portion 7, a photoconductive element 8, a developing portion 9, and an image transferring portion 10. The writing portion 7 transforms the color image data from the color sensor 6 to an optical signal and then writes it in the photoconductive element 8 to electrostatically form a latent image representative of the document image. Specifically, the writing portion 7 has a laser 7A, a polygonal mirror 7B for steering a beam issuing from the laser 7A, an f-theta lens 7C, and a mirror 7D. In the illustrative embodiment, the photoconductive element 8 is implemented as a drum rotatable in a direction indicated by an arrow in the figure. A charger 11, an optical path extending from the writing portion 7, the developing portion 9, the image transferring portion 10, a cleaning unit 12 and a discharge lamp 13 are sequentially arranged around the drum 8 in the direction of rotation of the drum 8 for performing consecutive copying steps.

Figure 2:
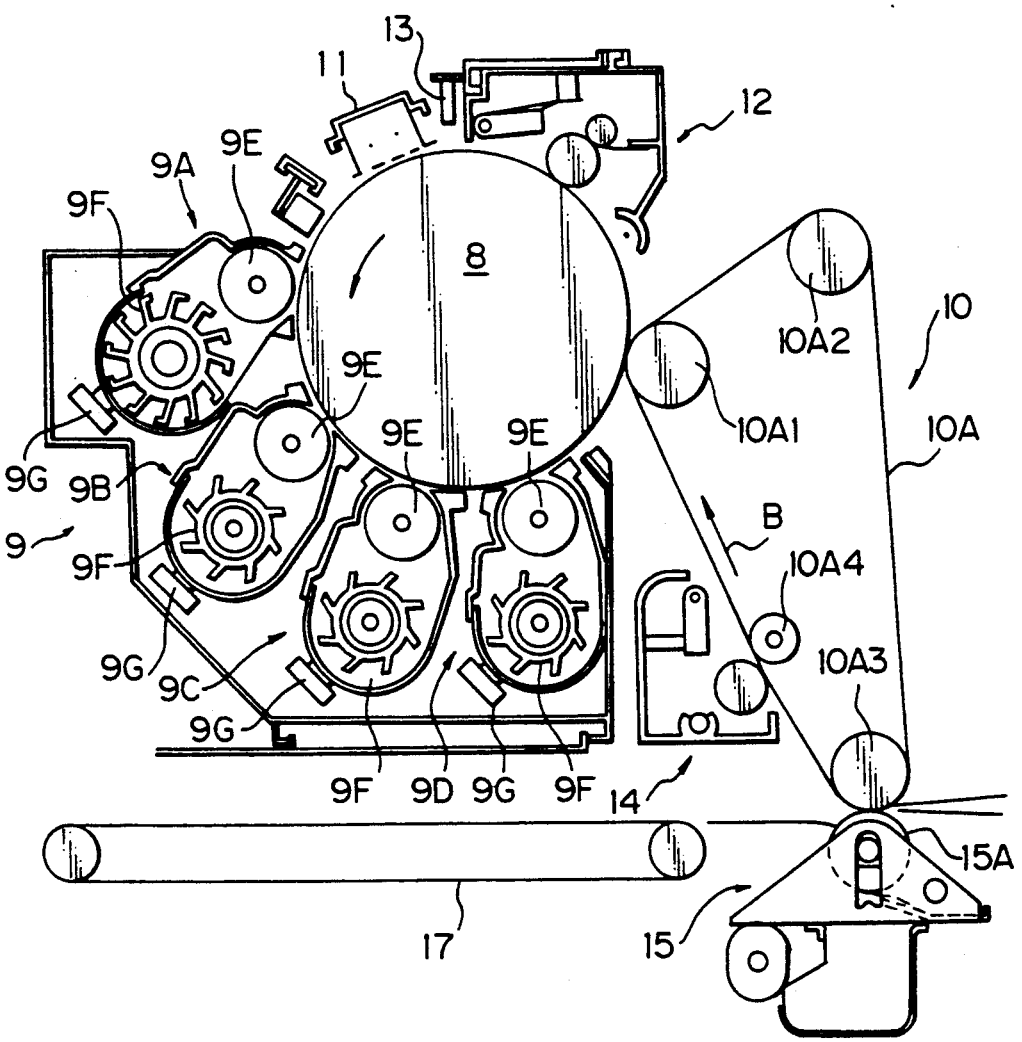
FIG. 2 is a fragmentary enlarged section of the embodiment.

As shown in FIG. 2, the developing portion 9 has a black developing unit 9A, a cyan developing unit 9B, a magenta developing unit 9C, and a yellow developing unit 9D. The developing units 9B-9D each store a developer of a particular color complementary to one of the colors separated by the document reading section 1A. All the developing units 9A-9D have a developing sleeve 9E, a rotatable paddle 9F, and a sensor 9G for sensing the density of the developer. The developing sleeve 9E is capable of causing the developer to form spikes thereon and contact the drum 8. The paddle 9F is rotatable to scoop up the developer while agitating it. The developing portion 9 is constructed such that only one of the developing units 9A-9D storing the developer associated in color with the latent image to be formed on the drum 8 operates, i.e., causes the developer to form spikes and electrostatically deposit on the latent image. The other developing units storing the developers of colors which are not complementary to the color of the latent image are held in a standby state without the developers thereof forming spikes.

As also shown in FIG. 2, the image transferring portion 10 has an intermediate image transfer body in the form of a belt 10A. The belt 10A is passed over a plurality of rollers including a backup roller 10A1 facing the drum 8, and a tension roller 10A2 facing the roller 10A1. A drive roller 10A3 is located in an image transfer position where an image will be transferred from the belt 10A to a paper sheet. The drive roller 10A3 moves the belt 10A in a direction indicated by an arrow B in the figure. A bias for transferring a developed image from the drum 8 to the belt 10A is applied to the backup roller 10A1 which faces the drum 8. Further, a roller 10A4 is located between the backup roller 10A1 and the drive roller 10A3 and faces a belt cleaning unit 14.

An image transfer unit 15 is positioned to face the drive roller 10A3 with the intermediary of the belt 10A. The image transfer unit 15 has a support portion movable toward and away from the belt 10A, and a bias roller 15A facing the drive roller 10A3 in the support portion. A bias for image transfer is applied to the bias roller 15A. A paper sheet or similar recording medium is fed from a paper feed device 16, FIG. 1, in synchronism with the leading end of an image carried on the belt 10A. While the paper sheet is nipped and driven by the belt 10A and image transfer unit 15, the image is transferred from the belt 10A to the paper sheet.

In FIG. 2, the reference numeral 17 designates a transport belt. In FIG. 1, the reference numerals 18 and 29 designate a fixing unit and a copy tray, respectively.

The belt 10A may be driven in any of three different modes on the basis of the drive mode of the drive roller 10A3, as follows.

(1) Constant speed forward mode: After an image of the first color has been transferred from the drum 8 to the belt 10A, the belt 10A is continuously moved at a constant speed. In this mode, image processing is effected at such a time that the leading end of an image of the next color formed on the drum 8 meets the leading end of the image existing on the belt 10A.

(2) Skip forward mode: After an image of the first color has been transferred from the drum 8 to the belt 10A, the belt 10A is moved away from the drum 8, moved in the same direction but at a higher speed than during the transfer of the image of the first color, again driven at the initial speed on moving a predetermined distance, and then brought into contact with the drum 8. In this mode, image processing on the drum 8 is also effected at such a time that the leading end of the image of the first color and that of the image of the second color meet. This mode prevents the image forming cycle time associated with drum 8 from being increased and may be used when, for example, the length of an image to be transferred is short relatively to the length of the belt 10A.

(3) Quick return mode: After an image of the first color has been transferred from the drum 8 to the belt 10A, the belt 10A is moved away from the drum 8, moved at a higher speed in the opposite direction, stopped in a position where the image existing on the belt 10A meets an image of the next color formed on the drum 8, and then brought into contact with the drum 8 and moved in the same direction as the drum 8. Such a procedure is repeated up to the time when an image of the last color is to be transferred. Again, the image processing with the drum 8 is effected at such a time that the image of the first color and the image of the next color meet each other. So far as the control for causing the image on the belt 10A to meet the image on the drum 8 is concerned, the quick return mode advantageously reduces the required distance which the belt 10A should move. Especially, this mode enhances rapid copying operations using paper sheets of small sizes.

Figure 3:
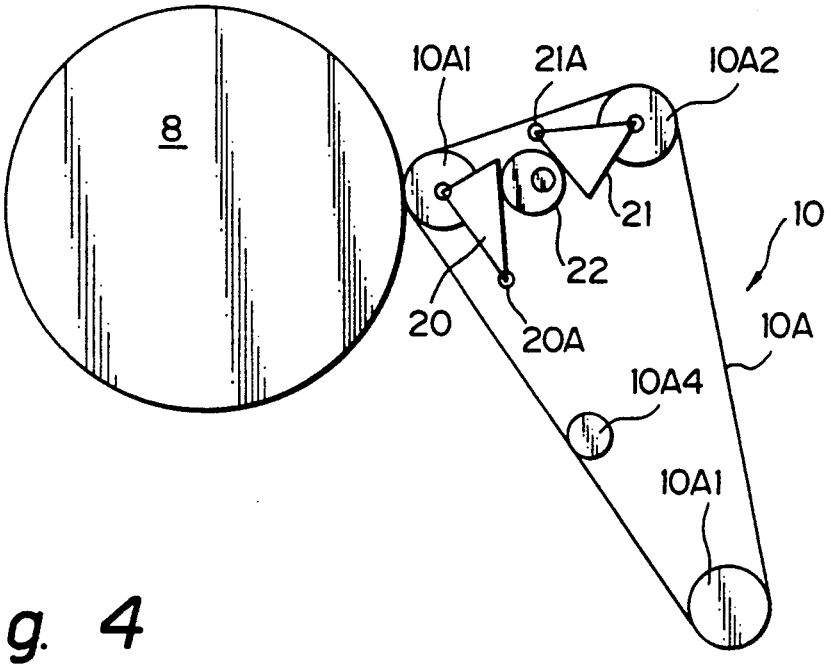
FIG. 3 shows essential part of the arrangement shown in FIG. 2.
Figure 4:
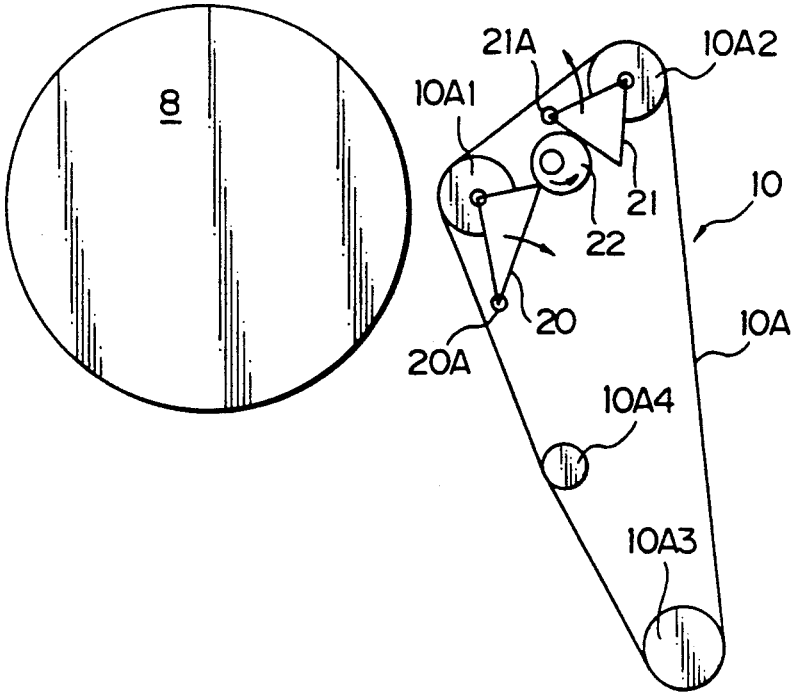
FIG. 4 shows a specific position of the arrangement shown in FIG. 3.

FIGS. 3 and 4 show a structure for moving the belt 10A toward and away from the drum 8 in the above-stated modes (1) and (2). As shown, the structure has a support member 20 supporting the backup roller 10A1 that faces the drum 8, a support member 21 supporting the tension roller 10A2, and a cam member 22. The support members 20 and 21 are respectively pivotable on shafts 20A and 21A supported by the framework of the image transfer portion 10, and each supports the associated roller 10A1 or 10A2 pivotably at the free end thereof. The facing edges of the support members, or pivotable levers, 20 and 21 are constantly pressed against the cam member 22 by biasing means, not shown. The cam member 22 intervening between the support members 20 and 21 is implemented as an eccentric cam. The distance from the center of rotation of the cam member 22 to the facing edge of each support member 20 or 21, i.e., the cam lift is selected such that when the cam member 22 rotates half a rotation, the support members 20 and 21 are moved in the same direction and over the same distance toward or away from the drum 8.

Initially, the cam member 22 assumes the position shown in FIG. 3. In this position, the backup roller 10A1 supported by the support member 20 and facing the drum 8 approaches the drum 8 while the tension roller 10A2 moves together with the roller 10A1. The belt 10A, therefore, remains in contact with the drum 8 to allow a developed image to be transferred from the drum 8 to the belt 10A.

In the skip forward mode and the quick return mode, the cam member 22 rotates half a rotation to move the belt 10A away from the drum 8. Then, the support members 20 and 22 pressed against the cam member 22 are moved in a direction matching the change in the cam lift. As a result, as shown in FIG. 4, the belt 10A is moved away from the drum 8 without the tension thereof changed.

In the illustrative embodiment, since a single cam member moves a plurality of roller support members at the same time, the structure is simple and, therefore, reduces the parts management cost and assembly cost.

Figure 5:
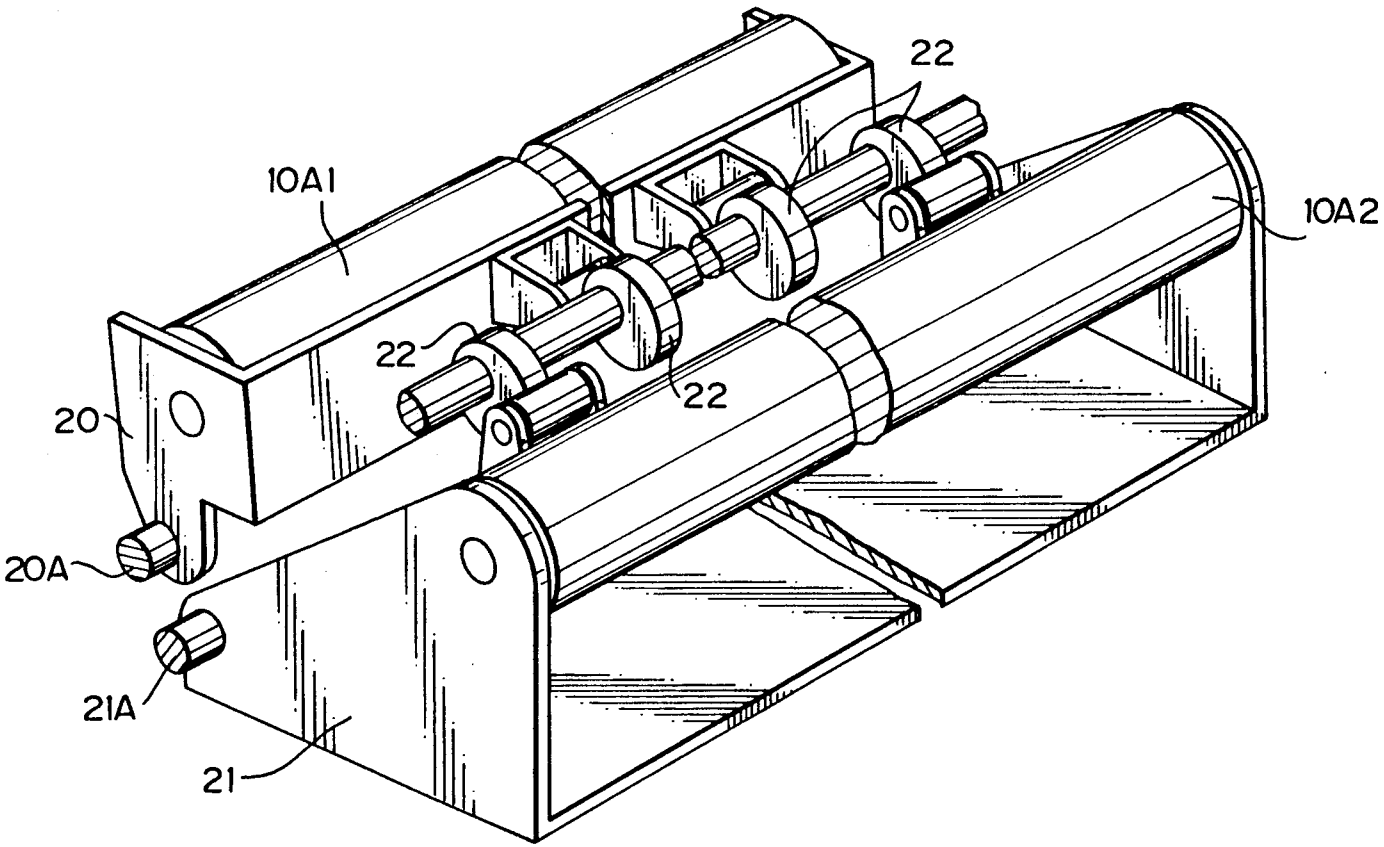
FIG. 5 is a perspective view of a modified form of the configuration shown in FIG. 3.

Alternatively, as shown in FIG. 5, the cam 22 may be provided in pairs which are spaced apart in the axial direction of the rollers 10A1 and 10A2.

In summary, it will be seen that the present invention provides a multicolor image forming apparatus in which, when an intermediate image transfer body is implemented as a belt movable toward and away from a photoconductive element, rollers over which the belt is passed can be moved at the same time in the same direction and over the same distance and, therefore, without changing the tension of the belt. This is successful in eliminating the dislocation of an image due to the slippage of the belt and, therefore, in insuring the accurate register of an image present on the photoconductive element and an image present on the belt.

Further, since the rollers are moved at the same time, the control over the movement of the belt toward and away from the photoconductive element and the movement in the reversible direction is simplified. Hence, the copying speed is increased without regard to the kind of the system for driving the intermediate image transfer body.

Various modifications will become possible for those skilled in the art after receiving the teachings of the present disclosure without departing from the scope thereof.

What is claimed is:

1. An image transfer structure for a multicolor image forming apparatus for sequentially transferring developed images of different colors formed one after another on a photoconductive element to an intermediate image transfer belt one above another, wherein a non-transfer period exists between periods of the transferring of the images of different colors to the intermediate image transfer belt, and then transferring said developed images from said intermediate image transfer belt to a recording medium at the same time to thereby form a full-color image, wherein said images are brought into register by either of a skip forward system which during the non-transfer period shifts said intermediate transfer belt away from said photoconductive element and moves said intermediate image transfer belt at a speed different from a previous speed and a quick return system which during the non-transfer period shifts said intermediate transfer belt away from said photoconductive element and moves said intermediate image transfer belt in a direction opposite to a previous direction, said image transfer structure comprising:

belt support means comprising a backup roller supporting the intermediate image transfer belt at a position where said backup roller faces the photoconductive element, and a tension roller applying tension to said intermediate image transfer belt; and roller drive means for shifting said backup roller and said tension roller to move said intermediate image transfer belt toward and away from the photoconductive element such that said intermediate image transfer belt has the same tension when shifted into contact with said photoconductive element and when shifted out of contact with said photoconductive element during the non-transfer period.

2. An image transfer structure for a multicolor image forming apparatus for sequentially transferring developed images of different colors formed one after another on a photoconductive element to an intermediate image transfer body one above another, wherein a non-transfer period exists between periods of the transferring of the images of different colors to the intermediate image transfer body, and then transferring said developed images from said intermediate image transfer body to a recording medium at the same time to thereby form a full-color image, wherein said images are brought into register by either of a skip forward system which during the non-transfer period shifts said intermediate transfer body away from said photoconductive element and moves said intermediate image transfer body at a speed different from a previous speed and a quick return system which during the non-transfer period shifts said intermediate image transfer body away from said photoconductive element and moves said intermediate image transfer body in a direction opposite to a previous direction, said image transfer structure comprising:

a belt constituting the intermediate image transfer body and passed over a plurality of rollers including a backup roller facing the photoconductive element and a tension roller; and support means for causing said backup roller and said tension roller to angularly move substantially at the same time such that said belt selectively moves toward or away from said photoconductive element and such that said belt has the same tension when shifted into contact with said photoconductive element and when shifted out of contact with said photoconductive element during the non-transfer period.

3. A structure as claimed in claim 2, wherein said support means is associated with each of said backup roller and said tension roller and supports associated one of said backup roller and said tension roller at a free end thereof, distances to the free ends of said support means being selected such that said backup roller and said tension roller move the same distance as each other.

4. A structure as claimed in claim 2, wherein said support means comprises a single eccentric cam intervening between said backup roller and said tension roller and causes, on half a rotation of said eccentric cam, said backup roller and said tension roller to selectively move toward or away from the photoconductive element over the same distance.

5. An image transfer structure for a multicolor image forming apparatus for sequentially transferring developed images of different colors, comprising:

a photoconductive element on which the developed images of different colors are formed;

an intermediate image transfer belt on which said developed images from said photoconductive element are transferred one above another, wherein a non-transfer period exists between periods of the transferring of the images of different colors to the intermediate image transfer belt;

a recording medium on which said developed images from the intermediate image transfer belt are transferred to thereby form a full-color image, wherein said images are brought into register by either of a skip forward system which during the non-transfer period shifts said intermediate image transfer belt away from said photoconductive element and moves said intermediate image transfer belt at a speed different from a previous speed and a quick return system which during the non-transfer period shifts said intermediate transfer belt away from said photoconductive element and moves said intermediate image transfer belt in a direction opposite to a previous direction;

belt support means comprising a backup roller supporting the intermediate image transfer belt at a position where said backup roller faces the photoconductive element and a tension roller applying tension to said intermediate image transfer belt; and roller drive means for shifting said backup roller and said tension roller in conjunction to move said intermediate image transfer belt toward and away from the photoconductive element such that said intermediate image transfer belt has the same tension when shifted into contact with said photoconductive element and when shifted out of contact with said photoconductive element during the non-transfer period.

6. A structure as claimed in claim 5, wherein said belt support means is associated with each of said backup roller and said tension roller and supports an associated one of said backup roller and said tension roller at a free end thereof, distances to the free ends of said support means being selected such that said backup roller and said tension roller move the same distance as each other.

7. A structure as claimed in claim 5, wherein said belt support means comprises an eccentric cam intervening between said backup roller and said tension roller and causes, on half a rotation of said eccentric cam, said backup roller and said tension roller to selectively move toward or away from the photoconductive element over the same distance.

8. An image transfer structure for a multicolor image forming apparatus for sequentially transferring developed images of different colors formed one after another on a photoconductive element to an intermediate image transfer belt one above another, wherein a non-transfer period exists between periods of the transferring of the images of different colors to the intermediate image transfer belt, and then transferring said developed images from said intermediate image transfer belt to a recording medium at the same time to thereby form a full-color image, wherein the intermediate image transfer belt is moved while being spaced apart from the photoconductive element during the non-transfer period, thereby bringing the images sequentially transferred from the photoconductive element into register on the intermediate image transfer belt, said image transfer structure comprising:

belt support means comprising a backup roller supporting the intermediate image transfer belt at a position where said backup roller faces the photoconductive element, and a tension roller applying tension to said intermediate image transfer belt; and roller drive means for shifting said backup roller and said tension roller to move said intermediate image transfer belt toward and away from the photoconductive element such that said intermediate image transfer belt has the same tension when shifted into contact with said photoconductive element and when shifted out of contact with said photoconductive element during the non-transfer period.

9. A structure as claimed in claim 8, wherein said intermediate image transfer belt is moved by either of a skip forward system which during a non-transfer period shifts said intermediate transfer belt away from said photoconductive element and moves said intermediate image transfer belt at a speed different from a previous speed and a quick return system which during a non-transfer period shifts said intermediate transfer belt away from said photoconductive element and moves said intermediate image transfer belt in a direction opposite to a previous direction.

10. A structure as claimed in claim 8, wherein the intermediate image transfer belt is supported while forming a closed loop.

11. An image transfer structure for a multicolor image forming apparatus for sequentially transferring developed images of different colors formed one after another on a photoconductive element to an intermediate image transfer body one above another, wherein a non-transfer period exists between periods of the transferring of the images of different colors to the intermediate image transfer body, and then transferring said developed images from said intermediate image transfer body to a recording medium at the same time to thereby form a full-color image, wherein the intermediate image transfer body is moved while being spaced apart from the photoconductive element during the non-transfer period, thereby bringing the images sequentially transferred from the photoconductive element into register on the intermediate image transfer body, said image transfer structure comprising:

a belt constituting the intermediate image transfer body and passed over a plurality of rollers including a backup roller facing the photoconductive element and a tension roller; and support means for causing said backup roller and said tension roller to angularly move substantially at the same time such that said belt selectively moves toward or away from said photoconductive element and such that said belt has the same tension when shifted into contact with said photoconductive element and when shifted out of contact with said photoconductive element during the non-transfer period.

12. A structure as claimed in claim 11, wherein said intermediate image transfer belt is moved by either of a skip forward system which during a non-transfer period shifts said intermediate transfer belt away from said photoconductive element and moves said intermediate image transfer belt at a speed different from a previous speed and a quick return system which during a non-transfer period shifts said intermediate transfer belt away from said photoconductive element and moves said intermediate image transfer belt in a direction opposite to a previous direction.

13. A structure as claimed in claim 11, wherein the intermediate image transfer belt is supported while forming a closed loop.

* * * * *